US007299574B2

(12) United States Patent
Dome

(10) Patent No.: US 7,299,574 B2
(45) Date of Patent: Nov. 27, 2007

(54) ADVERTISING MEDIUM FOR HELMET OR HAT

(76) Inventor: Jeffrey Dome, 8155 Crancreek Dr. NE., Ada, MI (US) 49301-8898

( * ) Notice: Subject to any disclaimer, the term of this patent is extended or adjusted under 35 U.S.C. 154(b) by 0 days.

(21) Appl. No.: 11/225,595

(22) Filed: Sep. 13, 2005

(65) Prior Publication Data

US 2006/0230654 A1 Oct. 19, 2006

Related U.S. Application Data

(62) Division of application No. 11/109,385, filed on Apr. 19, 2005.

(51) Int. Cl.
*G09F 3/00* (2006.01)

(52) U.S. Cl. ..... 40/329; D2/891

(58) Field of Classification Search ..... 40/329, 40/591, 210, 638, 593, 617, 209, 795, 790; 2/172

See application file for complete search history.

(56) References Cited

U.S. PATENT DOCUMENTS

| | | | | |
|---|---|---|---|---|
| 1,492,577 | A * | 5/1924 | Obermeyer | 2/5 |
| 2,095,437 | A * | 10/1937 | Fox | 40/638 |
| 3,825,952 | A * | 7/1974 | Pershing et al. | 2/422 |
| 3,945,044 | A | 3/1976 | McGee et al. | |
| 4,031,564 | A * | 6/1977 | Wood | 2/9 |
| 4,047,249 | A | 9/1977 | Booth | |
| 4,070,781 | A | 1/1978 | Sauer | |
| 4,076,373 | A | 2/1978 | Moretti | |
| 4,138,746 | A | 2/1979 | Bergmann | |
| 4,358,488 | A | 11/1982 | Dunklin et al. | |
| 4,455,689 | A | 6/1984 | Boyer | |
| 4,528,232 | A | 7/1985 | Cliffe | |
| 4,716,601 | A | 1/1988 | McNeal | |
| 4,940,622 | A | 7/1990 | Leavitt, Sr. et al. | |
| 5,002,326 | A | 3/1991 | Westfield et al. | |
| 5,110,655 | A * | 5/1992 | Engler et al. | 428/143 |
| 5,129,108 | A * | 7/1992 | Copeland et al. | 2/424 |

(Continued)

FOREIGN PATENT DOCUMENTS

| | | |
|---|---|---|
| DE | 3227366 | 1/1984 |

OTHER PUBLICATIONS

SportsStar football decal set http://web.archive.org/web/20031224125012/http://www.sportstarusa.com/fbdecals.html.*

(Continued)

*Primary Examiner*—Cassandra Davis
(74) *Attorney, Agent, or Firm*—Price, Heneveld, Cooper, DeWitt & Litton LLP

(57) ABSTRACT

A method of advertising comprising providing a sheet of advertising material having a front surface, front surface having advertising information thereon. The method also includes providing a sporting helmet having a head accepting portion and a facemask and connecting the sheet of advertising material to the sporting helmet such that at least a portion of the sheet of advertising material covers the facemask. The method could alternatively include providing headwear comprising a head accepting portion and applying the sheet of advertising material having adhesive on less then the entire rear surface thereof to the headwear. In another alternative, the method could include providing a vehicle having a rear bumper and applying the sheet of advertising material having adhesive on less then the entire rear surface thereof to the vehicle.

20 Claims, 4 Drawing Sheets

U.S. PATENT DOCUMENTS 5,234,005 A * 8/1993 Kittelsen et al. ..... 128/859
5,408,950 A * 4/1995 Porto ..... 116/239
5,479,658 A * 1/1996 Harris ..... 2/9
5,493,734 A * 2/1996 Nieves-Rivera ..... 2/209.13
5,525,177 A 6/1996 Ross
5,592,698 A 1/1997 Woods
5,609,938 A 3/1997 Shields
5,701,609 A * 12/1997 Bridges ..... 2/422
5,766,401 A 6/1998 Campbell et al.
5,773,110 A 6/1998 Shields
6,030,687 A 2/2000 Andriash
6,085,358 A 7/2000 Cogan
6,212,805 B1 4/2001 Hill
6,233,745 B1 * 5/2001 Friesen ..... 2/172
6,254,711 B1 7/2001 Bull et al.
6,358,598 B1 3/2002 Hicks
6,388,813 B1 5/2002 Wilson et al.
6,401,258 B1 * 6/2002 Wilson ..... 2/410
6,461,709 B1 10/2002 Janssen et al.
6,463,590 B1 10/2002 Dean et al.
6,482,488 B1 11/2002 Janssen et al.
6,536,045 B1 3/2003 Wilson et al.
6,725,467 B2 4/2004 Harding
6,777,055 B2 8/2004 Janssen et al.
6,847,492 B2 1/2005 Wilson et al.
6,870,686 B2 3/2005 Wilson et al.
6,874,170 B1 * 4/2005 Aaron ..... 2/468
2002/0109922 A1 8/2002 Wilson et al.
2002/0159159 A1 10/2002 Wilson et al.
2003/0087054 A1 5/2003 Janssen et al.
2004/0258933 A1 12/2004 Enniss et al.
2005/0002108 A1 1/2005 Wilson et al.

OTHER PUBLICATIONS

Riddlell Ohio State Buckeyes REplical Football Mini Helmet□□http://www.dicksportinggoods.com/product/index.jsp-?productid+1826577.*

* cited by examiner

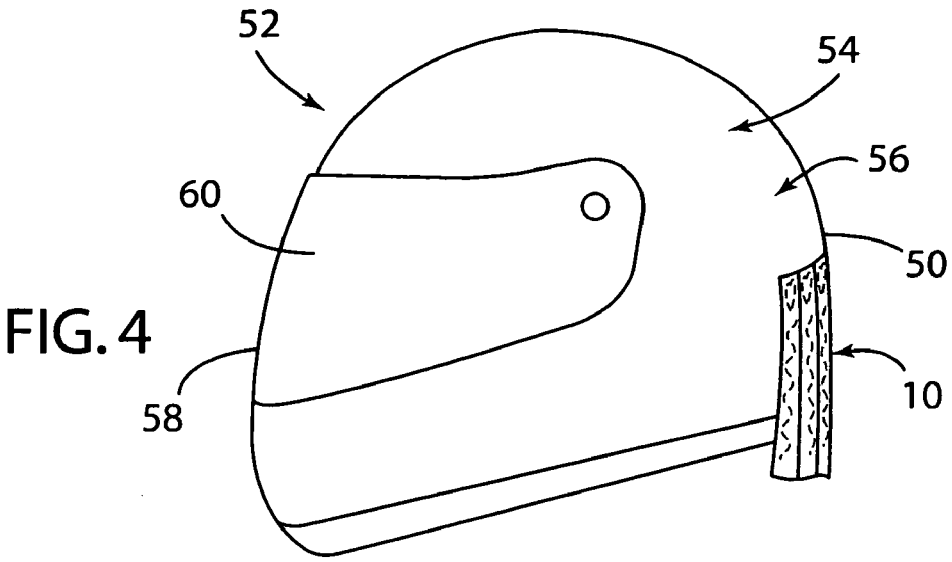
FIG. 4
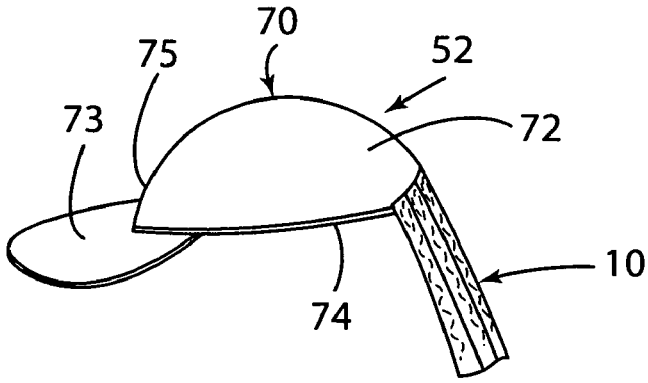
FIG. 5
FIG. 6
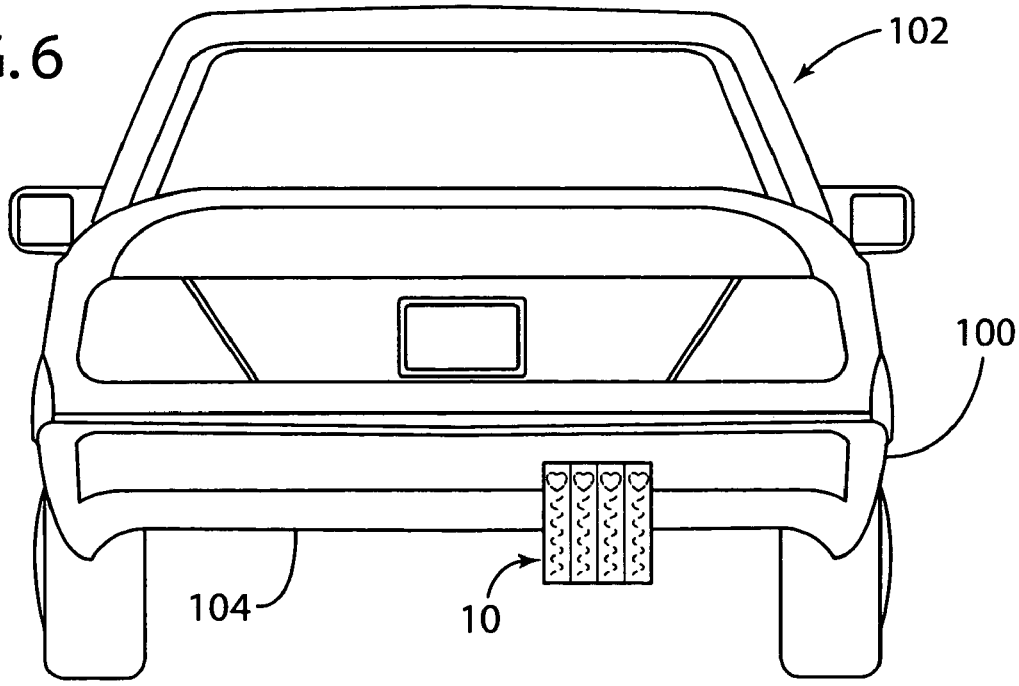

ADVERTISING MEDIUM FOR HELMET OR HAT

CROSS-REFERENCE TO RELATED APPLICATION

This application is a divisional of U.S. patent application Ser. No. 11/109,385, which was filed on Apr. 19, 2005 and entitled ADVERTISING MEDIUM FOR HELMET OR HAT.

FIELD OF THE INVENTION

The present invention relates to advertising and, more particularly, pertains to an advertising medium for attachment to various moving objects, such as a helmet, a hat or a vehicle.

BACKGROUND OF THE INVENTION

Every year millions of dollars are spent on advertising. However, companies are always looking for new ways to advertise their products or services. Furthermore, professional sports leagues use their advertising revenues to pay the players on the teams in the leagues and to pay for other operating expenses. For example, soccer leagues typically place advertising signs around the field and NASCAR® drivers place advertising on their vehicles and on their clothing. Like any other business, the sports leagues are always looking for new and improved ways to obtain advertising revenue.

Accordingly, a new method of advertising is desired.

SUMMARY OF THE PRESENT INVENTION

An aspect of the present invention is to provide a method of advertising comprising providing a sheet of advertising material having a front surface and a rear surface, with the front surface having advertising information thereon. The method also includes providing a sporting helmet having a head accepting portion and a facemask and connecting the sheet of advertising material to the sporting helmet such that at least a portion of the sheet of advertising material covers the facemask.

Another aspect of the present invention is to provide a method of advertising comprising providing a sheet of advertising material having a front surface and a rear surface, with the rear surface having adhesive on less than all of the rear surface. The method also includes providing headwear comprising a head accepting portion, with the head accepting portion including a front side configured to be above a face of a wearer of the headwear and a rear side configured to be above a rear of a head of the wearer of the headwear. The method further includes applying the sheet of advertising material to the headwear.

Yet another aspect of the present invention is to provide a method of advertising comprising providing a sheet of advertising material having a front surface and a rear surface, with the rear surface having adhesive on less than all of the rear surface. The method further includes providing a vehicle having a rear bumper and applying the sheet of advertising material to the rear bumper of the vehicle.

These and other aspects, objects, and features of the present invention will be understood and appreciated by those skilled in the art upon studying the following specification, claims, and appended drawings.

BRIEF DESCRIPTION OF DRAWINGS

FIG. 4 is a side view of a first embodiment of headwear illustrating a second use of the sheet of advertising material of the present invention.

FIG. 5 is a front view of a second embodiment of headwear illustrating the second use of the sheet of advertising material of the present invention.

FIG. 6 is a rear view of a vehicle illustrating a third use of the sheet of advertising material of the present invention.

DETAILED DESCRIPTION OF PREFERRED EMBODIMENTS

Figure 1:
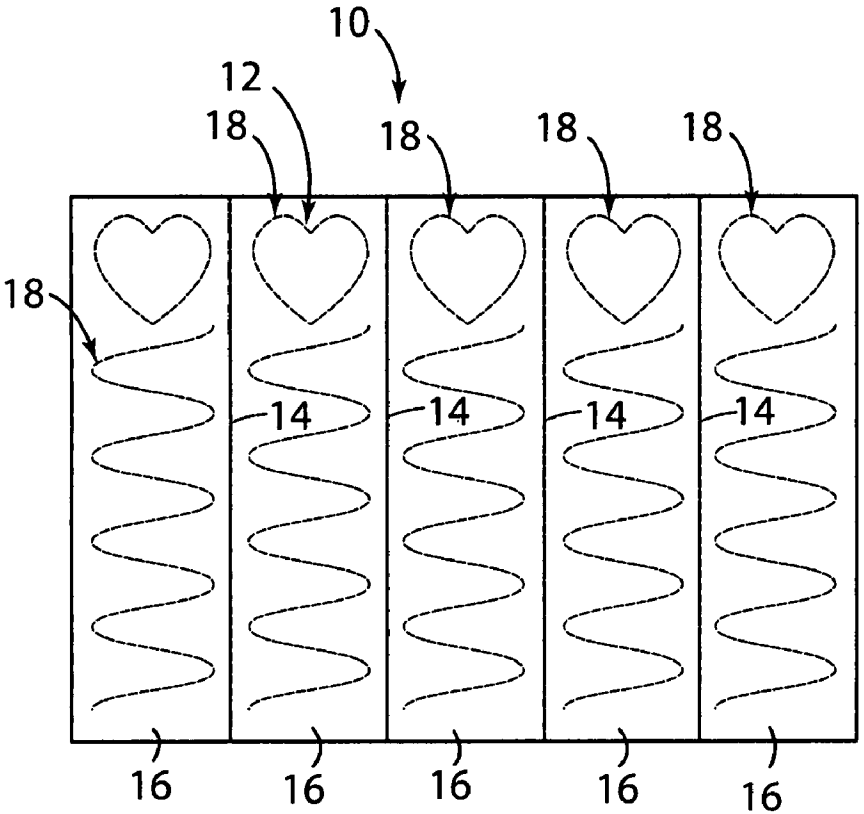
FIG. 1 is a front view of a first embodiment of a sheet of advertising material of the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIG. 1) generally designates a sheet of advertising material embodying the present invention. In the illustrated example, the sheet of advertising material 10 comprises any sheet of material having advertising information 12 thereon. The advertising information 12 can include any information relating to a particular company, industry, person or organization. For example, the advertising information can comprise a logo, contact information, promotional information, a coupon, a business name, a trademark, personal information (e.g., an athletic player's statistics) or any other information. In the illustrated example, the sheet of advertising material 10 can be made of paper, laminated paper, acrylic, an elastic material, fabric (e.g., Tyvek® sold by DuPont) or any other material. It is further contemplated that the sheet of advertising material could be made of a flame resistant or flame retardant material. The advertising information 12 can be printed on the sheet of advertising material 10 or applied to the sheet of advertising material 10 in any manner. The advertising information 12 can also comprise a hologram or can be reflective. While the sheet of advertising material 10 is illustrated as being rectangular, it is contemplated that the sheet of advertising material 10 can have any geometric shape. It is further contemplated that the sheet of advertising material 10 could be opaque, translucent or transparent.

In the illustrated example, the sheet of advertising material 10 includes a plurality of perforated lines 14 dividing the sheet of advertising material 10 into a plurality of subsheets 16 of advertising material. The sheet of advertising material 10 can be torn along the perforated lines 14 to remove one of the subsheets 16 of advertising material from the remainder of the sheet of advertising material 10. While the sheet of advertising material 10 is illustrated as including a plurality of perforated lines 14, it is contemplated that the sheet of advertising material could only include one or any number of perforated lines 14. In the illustrated embodiment, each subsheet 16 of advertising material includes an identical advertising message 18 thereon, with the advertising information 12 comprising all of the identical advertising messages 18.

Figure 2:
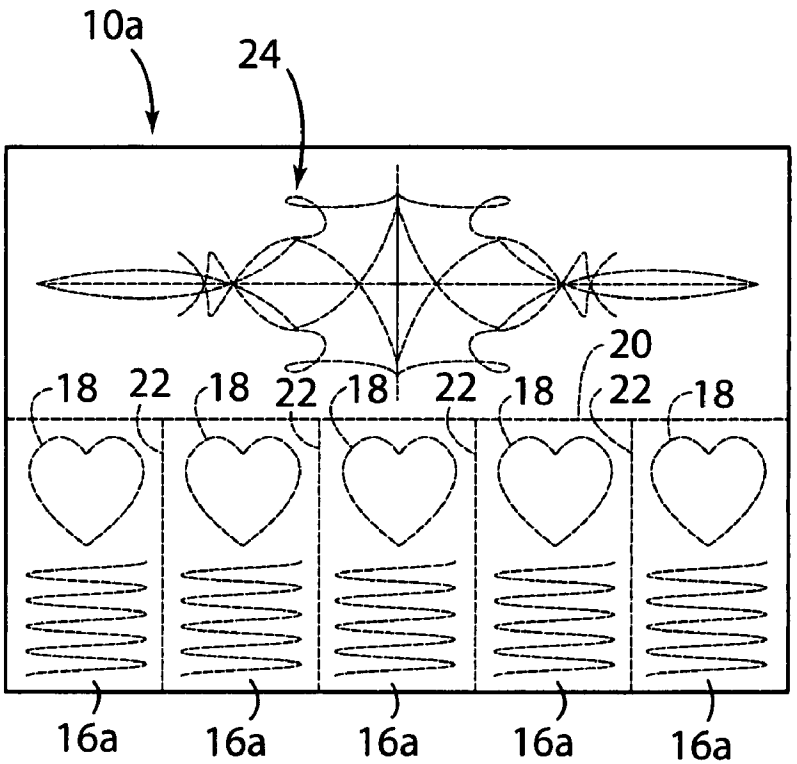
FIG. 2 is a front view of a second embodiment of the sheet of advertising material of the present invention.

The reference numeral 10*a* (FIG. 2) generally designates another embodiment of the present invention, having a second embodiment for the sheet of advertising material. Since the sheet of advertising material 10*a* is similar to the previously described sheet of advertising material 10, similar parts appearing in FIG. 1 and FIG. 2, respectively, are represented by the same, corresponding reference number, except for the suffix "a" in the numerals of the latter. The second embodiment of the sheet of advertising material 10*a* includes one horizontal perforated line 20 and a plurality of vertical perforated lines 22 to define a main area 24 of advertising above the horizontal perforated line 20 and the plurality of subsheets 16*a* below the horizontal perforated line 20.

Figure 3:
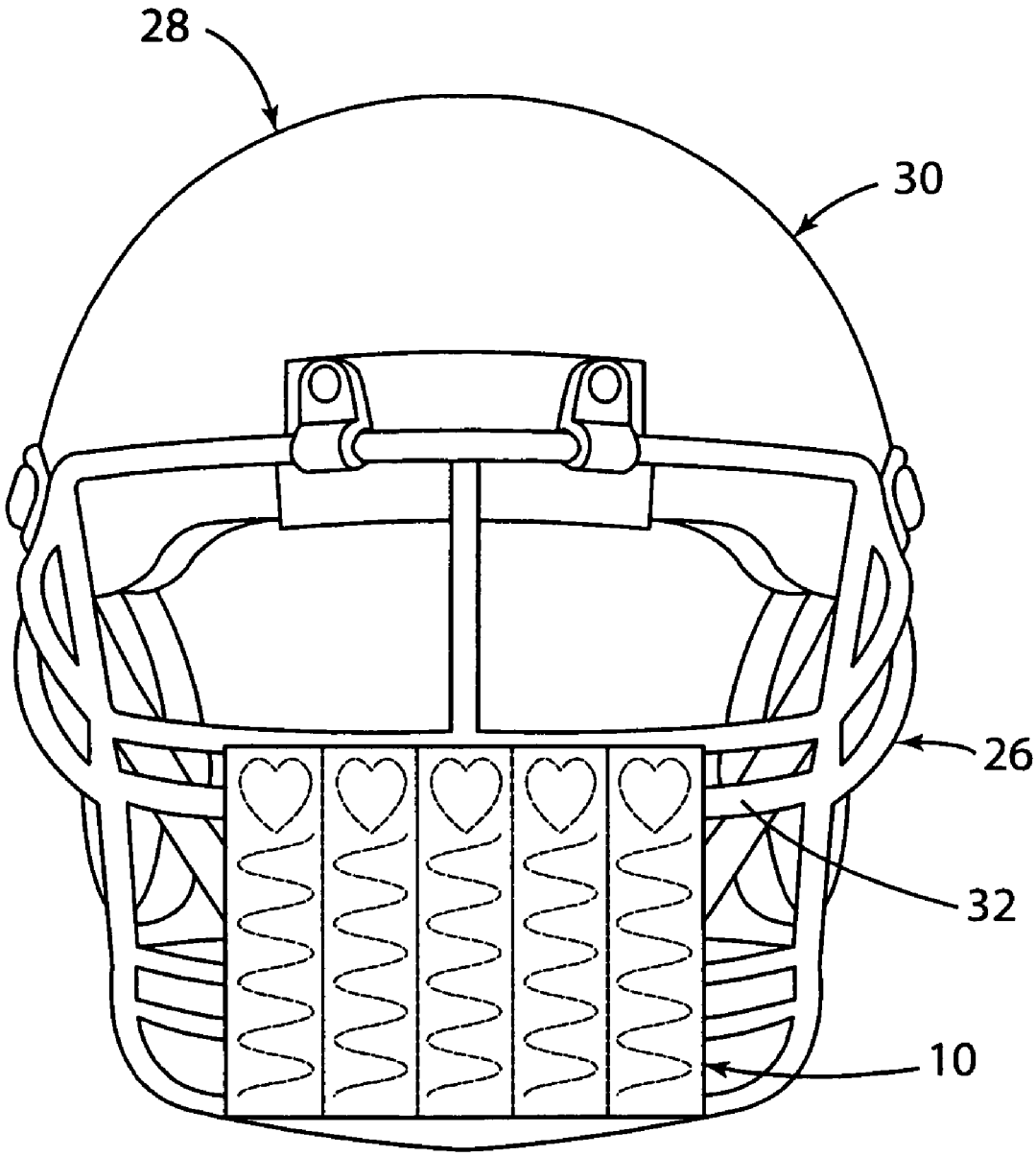
FIG. 3 is a front view of a sporting helmet illustrating a first use of the sheet of advertising material of the present invention.

FIG. 3 illustrates a first use for the first embodiment of the sheet of advertising material 10 or the second embodiment of the sheet of advertising material 10*a*, wherein the sheet of advertising material 10, 10*a* is applied to a facemask 26 of a sporting helmet 28. In the illustrated embodiment, the sporting helmet 28 is shown as being a football helmet 28. However, it is contemplated that the sporting helmet 28 could be for any sporting helmet 28 for any sport. For example, the sporting helmet 28 could be a football helmet, a hockey helmet (having either a grill or a clear shield) or a lacrosse helmet. The sporting helmet 28 includes a head accepting portion 30, with the facemask 26 extending from the head accepting portion 30. The facemask 26 comprises at least one bar 32 extending from the head accepting portion 30. In the first use of the sheet of advertising material 10, 10*a*, the sheet of advertising material 10, 10*a* includes a front surface and a rear surface, with adhesive applied to the rear surface of the sheet of advertising material 10, 10*a*. The sheet of advertising material 10, 10*a* is then applied to the facemask 26 of the sporting helmet 28.

During the first use of the sheet of advertising material 10, 10*a*, an athlete using the sporting helmet 28 places the athlete's head within the head accepting portion 30 to wear the sporting helmet 28 having the sheet of advertising material 10, 10*a* applied thereto. The sheet of advertising material 10, 10*a* can be applied to the facemask 26 either before or after the sporting helmet 28 is placed on the athlete's head. Accordingly, when the athlete enters to field, arena, etc. wearing the sporting helmet 28 having the sheet of advertising material 10, 10*a* applied thereto, the athlete advertises the sheet of advertising material 10, 10*a* to all of the spectators watching the athlete (either live or remotely through, e.g., a television). Furthermore, the athlete or another person can tear the sheet of advertising material 10, 10*a* along one of the perforated lines 14 (or 20 and/or 22) and give one of the subsheets 16, 16*a* of advertising material to a spectator. As described above, the subsheet 16, 16*a* can include a logo, contact information, promotional information, a coupon, a business name, a trademark, personal information (e.g., an athletic player's statistics) or any other information. Therefore, the athlete can use to sheet of advertising material 10, 10*a* to promote the athlete, the athlete's team or any other business.

FIGS. 4 and 5 illustrate a second use for the first embodiment of the sheet of advertising material 10 or the second embodiment of the sheet of advertising material 10*a* wherein the sheet of advertising material 10, 10*a* includes adhesive on less than the entire rear surface of the sheet of advertising material 10, 10*a*. Preferably, the sheet of advertising material 10, 10*a* is applied to a rear side 50 of headwear 52. However, it is contemplated that the sheet of advertising material 10, 10*a* can be applied to any portion of the headwear 52. As illustrated in FIG. 4, the headwear 52 can be a motorcycle helmet 54 having a head accepting portion 56, with the head accepting portion 56 including a front side 58 configured to be above a face of a wearer of the headwear 52 and the rear side 50 configured to be above a rear of a head of the wearer of the headwear 52. In the illustrated example, the motorcycle helmet 54 includes a transparent mask 60 extending from the front side 58 of the head accepting portion 56, with the transparent mask 60 configured to be positioned in front of the wearer of the headwear 52 for protection. However, it is contemplated that the motorcycle helmet 54 does not have to have a transparent mask 60. Furthermore, while the transparent mask 60 is shown as being configured to cover the entire face of the wearer of the motorcycle helmet 54, it is contemplated that the transparent mask 60 could be a half-shield.

As illustrated in FIG. 5, the headwear 52 can be a baseball cap 70 having a head accepting portion 72, with the head accepting portion 72 including a front side 75 configured to be above a face of a wearer of the headwear 52 and the rear side 50 configured to be above a rear of a head of the wearer of the headwear 52. The baseball cap 70 includes a bill 73 extending forwardly from the front side 75 of the head accepting portion 56, with the bill 73 being configured to shade eyes of the wearer of the headwear 52 when the headwear 52 is worn. However, it is contemplated that the headwear 52 could be any item placed on a head of a person (e.g., stocking cap, cowboy hat, visor, etc.). Furthermore, the headwear 52 could be the sporting helmet 28 as described above in the first use of the sheet of advertising material 10, 10*a*, with the sheet of advertising material 10, 10*a* applied to the rear side of the sporting helmet 28.

In the second use of the sheet of advertising material 10, 10*a*, the sheet of advertising material 10, 10*a* includes a front surface and a rear surface, with adhesive applied to a top portion of the rear surface of the sheet of advertising material 10, 10*a*. The sheet of advertising material 10, 10*a* is then applied to the headwear 52. In the illustrated embodiment, the sheet of advertising material 10, 10*a* is on the rear side of the headwear 52, with the sheet of advertising material 10, 10*a* hanging below a bottom 74 of the headwear 52 when the headwear 52 is worn by the wearer of the headwear 52. However, it is contemplated that the sheet of advertising material 10, 10*a* could be applied anywhere to the headwear 52. The sheet of advertising material 10, 10*a* can be applied to the headwear 52 either before or after the headwear 52 is worn. Accordingly, when a person wears the headwear 52 having the sheet of advertising material 10, 10*a* applied thereto, the person advertises the sheet of advertising material 10, 10*a* to all people watching the person (e.g., someone watching the person drive the motorcycle, wear the baseball cap during warm-ups before a baseball or softball game, etc.). Furthermore, the wearer can tear the sheet of advertising material 10, 10*a* along one of the perforated lines 14 (or 20 and/or 22) and give one of the subsheets 16, 16*a* of advertising material to anyone. As described above, the subsheets 16, 16*a* can include a logo, contact information, promotional information, a coupon, a business name, a trademark, personal information (e.g., an athletic player's statistics) or any other information.

Figure 7:
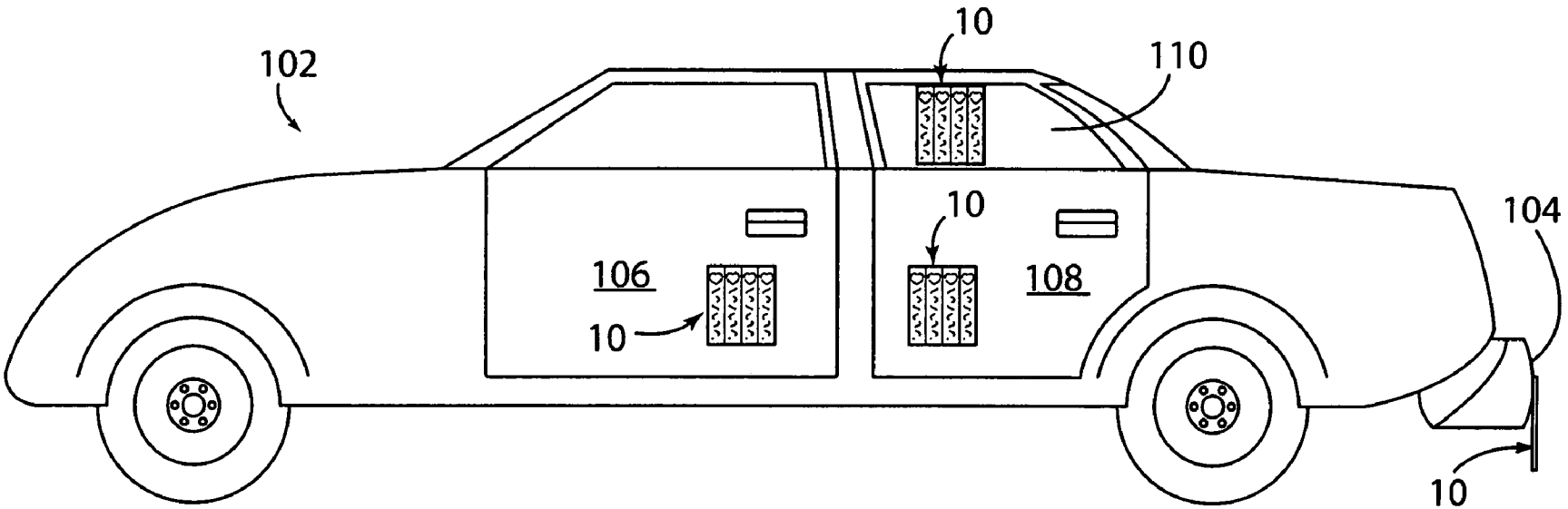
FIG. 7 is a side view of the vehicle illustrating the third use of the sheet of advertising material of the present invention.

FIGS. 6-7 illustrate a third use for the first embodiment of the sheet of advertising material 10 or the second embodiment of the sheet of advertising material 10*a* wherein the sheet of advertising material 10, 10*a* is applied to a vehicle 102. In the illustrated embodiment, the sheet of advertising material 10, 10*a* is applied to a rear bumper 100 of a vehicle 102. Preferably, the sheet of advertising material 10, 10*a* hangs below a bottom 104 of the rear bumper 100. The vehicle could be any vehicle (e.g., car, van, truck, motorcycle, bicycle, etc.). In the third use of the sheet of advertising material 10, 10*a*, the sheet of advertising material 10, 10*a* includes a front surface and a rear surface, with adhesive applied to a top portion of the rear surface (or less than the entire rear surface) of the sheet of advertising material 10, 10*a*. The sheet of advertising material 10, 10*a* is then applied to vehicle 102. Preferably, the sheet of advertising material 10, 10*a* is applied to the rear bumper 100 of the vehicle 102, with the sheet of advertising material 10, 10*a* hanging below the bottom 104 of the rear bumper 100. However, it is contemplated that the sheet of advertising material 10, 10*a* could be applied anywhere to the vehicle 102. For example, the sheet of advertising material could be applied to a front door 106, a rear door 108 or a rear side window 110. Accordingly, when a person drives the vehicle 102 having the sheet of advertising material 10, 10*a* applied thereto, the person advertises the sheet of advertising material 10, 10*a* to all people watching the vehicle (e.g., on the road or parked). Furthermore, the person driving the vehicle can tear the sheet of advertising material 10, 10*a* along one of the perforated lines 14 (or 20 and/or 22) and give one of the subsheets 16, 16*a* of advertising material to anyone. As described above, the subsheets 16, 16*a* can include a logo, contact information, promotional information, a coupon, a business name, a trademark, personal information (e.g., an athletic player's statistics) or any other information.

It is to be understood that variations and modifications can be made on the aforementioned structure without departing from the concepts of the present invention. For example, the sheet of advertising material 10 does not have to include the perforated lines 14. Moreover, it is contemplated that the sheet of advertising material 10, 10*a* could have adhesive on less than all of the rear surface and the sheet of advertising material 10, 10*a* could be connected anywhere to a person (e.g., back, coat, shirt, pants, shorts, chest, anywhere on the skin, etc.) Furthermore, it is to be understood that such concepts are intended to be covered by the following claims unless these claims by their language expressly state otherwise.

I claim:

1. A method of advertising comprising:

providing a sheet of advertising material having a front surface and a rear surface, the front surface having advertising information thereon, the rear surface of the sheet of advertising material has adhesive on at least a portion thereof, the sheet including tear lines extending below the adhesive and that define a plurality of strips that can be selectively removed by tearing along the tear lines;

providing a sporting helmet having a head accepting portion and a facemask;

connecting the sheet of advertising material to the sporting helmet such that at least a portion of the sheet of advertising material covers the facemask with the strips hanging downward; and adhering the sheet of advertising material to the facemask using the adhesive.

2. The method of advertising of claim 1, wherein:

the facemask comprises at least one bar extending from the head accepting portion.

3. The method of advertising of claim 1, wherein:

the sheet of advertising material is opaque.

4. The method of advertising of claim 1, wherein:

the sheet of advertising material is substantially transparent.

5. The method of advertising of claim 1, wherein:

the advertising information is reflective.

6. A method of advertising comprising:

providing a sheet of advertising material having a front surface and a rear surface, the rear surface having adhesive on less than all of the rear surface and including tear lines extending below the adhesive and that define a plurality of strips that can be selectively removed by tearing along the tear lines;

providing headwear comprising a head accepting portion and a transparent mask extending from the front side of the head accepting portion, the transparent mask configured to be positioned in front of the wearer of the headwear, the head accepting portion including a front side configured to be above a face of a wearer of the headwear and a rear side configured to be above a rear of a head of the wearer of the headwear; and applying the sheet of advertising material to the headwear;

wherein applying the sheet of advertising material to the headwear comprises applying the sheet of advertising material to the head accepting portion of the headwear with the strips hanging downward.

7. The method of advertising of claim 6, wherein:

applying the sheet of advertising material comprises hanging the sheet of advertising material below a bottom of the headwear when the headwear is worn by the wearer of the headwear.

8. The method of advertising of claim 7, wherein:

the sheet of advertising is applied to the rear side of the headwear.

9. The method of advertising of claim 6, wherein:

the headwear comprises a sporting helmet having the head accepting portion and a facemask.

10. The method of advertising of claim 9, wherein:

the facemask comprises at least one bar extending from the head accepting portion.

11. The method of advertising of claim 6, wherein:

the sheet of advertising material is opaque.

12. The method of advertising of claim 6, wherein:

the sheet of advertising material is substantially transparent.

13. The method of advertising of claim 6, wherein:

the front surface of the sheet of advertising material includes reflective advertising information thereon.

14. The method of advertising of claim 6, wherein:

the sheet of advertising material has an advertising message.

15. The method of advertising defined in claim 6, including a step of selectively tearing off at least one of the strips.

16. The method of advertising defined in claim 6, wherein the tear lines include perforations.

17. A method of advertising comprising:

providing a sheet of advertising material having a front surface and a rear surface, the rear surface having attachment structure on less than all of the rear surface and including tear lines extending from attachment structure to define a plurality of strips that can be selectively removed by tearing along the tear lines;

providing headwear comprising a head accepting portion, the head accepting portion including a front side configured to be above a face of a wearer of the headwear and a rear side configured to be above a rear of a head of the wearer of the headwear; and applying the sheet of advertising material to the headwear, including applying the sheet of advertising material to the head accepting portion of the headwear with the strips extending from the head accepting portion to facilitate individual removal of a selected one of the strips.

18. The method of advertising of claim 17, wherein the strips extend downwardly below a bottom of the headwear when the headwear is worn by the wearer of the headwear.

19. The method of advertising of claim 17, wherein:

the sheet of advertising is applied to the rear side of the headwear.

20. The method of advertising of claim 17, wherein:

the attachment structure includes adhesive, and wherein applying the sheet includes using the adhesive to attach the sheet to the headwear.

* * * * *